US005895171A

United States Patent [19]

Wiley et al.

[11] Patent Number: 5,895,171

[45] Date of Patent: Apr. 20, 1999

[54] PROCESS FOR HEATING AN ASPHALT SURFACE AND APPARATUS THEREFOR

[75] Inventors: Patrick C. Wiley, Vancouver; Mostafa Joharifard, West Vancouver, both of Canada

[73] Assignee: Martec Recycling Corporation, Vancouver, Canada

[21] Appl. No.: 08/793,693

[22] PCT Filed: Sep. 1, 1995

[86] PCT No.: PCT/CA95/00505

§ 371 Date: Feb. 27, 1997

§ 102(e) Date: Feb. 27, 1997

[87] PCT Pub. No.: WO96/07794

PCT Pub. Date: Mar. 14, 1996

[30] Foreign Application Priority Data

Sep. 2, 1994 [CA] Canada ..... 2131429

[51] Int. Cl.[6] ..... E01C 7/06; E01C 23/14

[52] U.S. Cl. ..... 404/77; 404/79; 404/95

[58] Field of Search ..... 404/77, 79, 95

[56] References Cited

U.S. PATENT DOCUMENTS

| | | | |
|---|---|---|---|
| 3,361,042 | 1/1968 | Cutler . | |
| 3,843,274 | 10/1974 | Gutman et al. . | |
| 3,970,404 | 7/1976 | Benedetti . | |
| 3,989,401 | 11/1976 | Moench . | |
| 4,011,023 | 3/1977 | Cutler . | |
| 4,124,325 | 11/1978 | Cutler . | |
| 4,129,398 | 12/1978 | Schoelkopf . | |
| 4,226,552 | 10/1980 | Moench . | |
| 4,319,856 | 3/1982 | Jeppson | 404/79 |
| 4,335,975 | 6/1982 | Schoelkopf . | |
| 4,534,674 | 8/1985 | Cutler . | |
| 4,545,700 | 10/1985 | Yates . | |
| 4,559,922 | 12/1985 | Crupi et al. . | |
| 4,561,800 | 12/1985 | Hatakenaka et al. | 404/79 |
| 4,711,600 | 12/1987 | Yates . | |
| 4,784,518 | 11/1988 | Cutler . | |
| 4,793,730 | 12/1988 | Butch . | |
| 4,850,740 | 7/1989 | Wiley . | |
| 4,929,120 | 5/1990 | Wiley et al. . | |
| 5,114,284 | 5/1992 | Keizer et al. | 404/95 |
| 5,139,362 | 8/1992 | Richter et al. | 404/95 |

FOREIGN PATENT DOCUMENTS 29 51 631 7/1981 Germany .

*Primary Examiner*—Thomas B. Will
*Assistant Examiner*—Gary S. Hartmann
*Attorney, Agent, or Firm*—Evenson, McKeown, Edwards & Lenahan, P.L.L.C.

[57] ABSTRACT

A process for heating an asphalt surface and an apparatus therefor. The process comprises the steps of: igniting in a burner (30) a combustible mixture comprised of a fuel (50) and oxygen (60) to produce a hot gas; and feeding the hot gas to an enclosure having a radiative face (200) disposed above the asphalt surface (280). The asphalt surface heating apparatus comprises a hot gas producing burner (30) and an enclosure (25) comprising an inlet (120) for receiving hot gas from the burner and a radiative face (200) having a plurality of apertures. The apertures in the radiative face are of a dimension such that the hot gas: (i) heats the radiative face to provide radiation heat transfer to the asphalt surface; and (ii) passes through the apertures to provide convection heat transfer to the asphalt surface.

19 Claims, 2 Drawing Sheets

PROCESS FOR HEATING AN ASPHALT SURFACE AND APPARATUS THEREFOR

TECHNICAL FIELD

The present invention relates to a process for heating an asphalt surface and to apparatus therefor.

BACKGROUND ART

As used herein, the term asphalt also comprises macadam and tarmac. Asphalt paved road surfaces typically comprise a mixture of asphalt cement (typically a black, sticky, petrochemical binder) and an aggregate comprising appropriately sized stones and/or gravel. The asphalt concrete mixture is usually laid, compressed and smoothed to provide an asphalt paved road surface.

Over time, an asphalt paved road surface can deteriorate as a result of a number of factors. For example, seasonal temperature fluctuations can cause the road surface to become brittle and/or cracked. Erosion or compaction of the road bed beneath the road surface may also result in cracking. Moreover, certain of the chemical constituents incorporated in fresh asphalt are gradually lost over time or their properties changed with time, further contributing to brittleness and/or cracking of the road surface. Where concentrated cracking occurs, pieces of pavement may become dislodged. This dislodgement can create traffic hazards, and accelerates the deterioration of adjacent pavement and highway substructure. Even if cracking and the loss of pavement pieces do not occur, the passage of traffic can polish the upper highway surface, and such a surface can be slippery and dangerous. In addition, traffic-caused wear can groove, trough, rut and crack a highway surface. Under wet highway conditions, water can collect in these imperfections and set up dangerous vehicle hydro-planing phenomena. Collected water also contributes to the further deterioration of the pavement.

Prior to about the 1970's, available methods for repairing old asphalt-paved road surfaces included: spot treatments such as patching or sealing, paving with new materials over top of the original surface, and removal of some of the original surface and replacement with new materials. Each of these methods had inherent drawbacks and limitations.

Since about the early 1970's, with increasing raw material, oil and energy costs, there has been a growing interest in trying to recycle the original asphalt. The world's highways have come to be recognized as a very significant renewable resource.

Early recycling techniques involved removing some of the original surface and transporting it to a centralized, stationary recycling plant where it would be mixed with new asphalt and/or rejuvenating chemicals. The rejuvenated paving material would then be trucked back to the work site and laid. These techniques had obvious limitations in terms of delay, transportation costs and the like.

Subsequently, technology was developed to recycle the old asphalt at the worksite in the field. Some such processes involved heating and are frequently referred to as "hot-in-place recycling" (hereinafter referred to as HIPR).

This technology comprises many known processes and machines in the prior art for recycling asphalt paved surfaces where the asphalt has broken down. Generally, these processes and machines operate on the premise of (i) heating the paved surface (typically by using large banks of heaters) to facilitate softening or plasticization of an exposed layer of the asphalt; (ii) mechanically breaking up (typically using devices such as rotating, toothed grinders; screw auger/mills; and rake-like scarifiers) the heated surface; (iii) applying fresh asphalt or asphalt rejuvenant to the heated, broken asphalt; (iv) distributing the mixture from (iii) over the road surface; and (v) compacting or pressing the distributed mixture to provide a recycled asphalt paved surface. In some cases, the heated, broken material can be removed altogether from the road surface, treated off the road surface and then returned to the surface and pressed into finished position. Much of the prior art relates to variations of some kind on this premise.

Over time, HIPR has had to address certain problems, some of which still exist today. For example, asphalt concrete (especially the asphalt cement within it) is susceptible to damage from heat. Thus, the road surface has to be heated to the point where it was sufficiently softened for practical rupturing, but not to the point of harming it. Furthermore, it was recognized that asphalt concrete is increasingly hard to heat as the depth of the layer being heated increases.

Many patents have attempted to address these problems. See, for example, the following patents, each of which is incorporated herein by reference:

U.S. Pat. No. 3,361,042 (Cutler) U.S. Pat. No. 3,970,404 (Benedetti)

U.S. Pat. No. 3,843,274 (Gutman et al.) U.S. Pat. No. 3,989,401 (Moench)

U.S. Pat. No. 4,011,023 (Cutler) U.S. Pat. No. 4,124,325 (Cutler)

U.S. Pat. No. 4,129,398 (Schoelkopf) U.S. Pat. No. 4,335,975 (Schoelkopf)

U.S. Pat. No. 4,226,552 (Moench) U.S. Pat. No. 4,534,674 (Cutler)

U.S. Pat. No. 4,545,700 (Yates) U.S. Pat. No. 4,711,600 (Yates)

U.S. Pat. No. 4,784,518 (Cutler) U.S. Pat. No. 4,793,730 (Butch)

U.S. Pat. No. 4,850,740 (Wiley) U.S. Pat. No. 4,929,120 (Wiley et al.)

Regardless of the specific technique used, commercially successful asphalt surface recycling is largely dependent on the ability to heat the old asphalt surface to be recycled in an efficient manner. Generally, efficient heating is achieved when the asphalt surface is heated to the desired temperature (eg. 300° F.) both quickly and without substantial scorching or overheating.

It is conventional in the art to utilize a heater to soften the asphalt thereby facilitating recycling thereof. The heater may be a radiant heater (e.g. infrared heater), a hot air heater, a convection heater, a microwave heater, a direct flame heater and the like.

By far the most popular commercially utilized heater is a radiant heater emitting infrared radiation. Generally, such a heater operates by igniting a fuel/air mixture over a metal (or other suitable material) screen resulting in combustion of the mixture. The heat of combustion is absorbed by the metal screen which, in most cases, results the metal screen glowing red and radiating the asphalt surface with heat (i.e. infrared radiation). One of the significant limitations of conventional radiant heaters is the source of fuel. Specifically, since the fuel/air mixture must be combusted of the entire radiative surface of the heater, the fuel must be of a nature which enables it to be readily mixed with air and distributed substantially evenly over the radiative surface up to the point of ignition. The result of this is that virtually all commercially available radiation heaters are fuelled by propane or butane. Propane and butane are gases which may be readily mixed with air for use in this application.

Unfortunately, propane and butane are very hazardous materials to handle and use since they are typically stored under pressure which can lead to a dangerous explosion in the event of an accidental spark. Further, there are a number of countries in the world in which propane and/or butane are: (i) unavailable, (ii) prohibitively expensive, and/or (iii) unattractive in the face of other available lower cost liquid fuels such as diesel fuel. Indeed, one or more of these problems exist in most countries in the world outside North America, Europe and Australia. With regard to (iii), liquid fuels (i.e. fuels which are liquid at ambient temperature and pressure) are unsuitable for use in conventional radiation heaters due to the difficulties associated with atomizing such fuels in air and distributing the fuel/mixture substantially evenly over the radiative surface of the heater. The net result of this is that HIPR is commercially impractical in most countries in the world outside North America and Europe.

Further, with conventional radiation heaters, the temperature of the radiative surface can easily reach 2000° F. or more. This results from the need to heat the surface as quickly as possible so that the progression of all vehicles associated with the recycling system is not delayed. This, coupled with the need to heat the surface of the asphalt to a temperature of 300° to 400° F. with the ultimate goal of attaining an average temperature of about 250° F. a depth of at least 2 inches, can often lead to scorching or overheating of the asphalt surface. Unfortunately, attempts to obviate this effect simply by lowering the temperature of the radiative surface, leads to even poorer efficiencies in the overall recycling process and thus, is not consideration a commercially viable alternative. A further problem associated with conventional radiation heaters is the high potential for non-uniform heating. Typically, this results from certain areas in the asphalt surface attracting radiation (e.g. oil spots) and other areas reflecting radiation (e.g. light coloured aggregate). The problem is exasperated in areas of the asphalt surface attracting radiation since this typically leads to severe smoking and/or ignition of the asphalt surface thereby creating a significant environmental concern.

As alluded to above, a conventional asphalt surface heater is a hot air heater. Such a heater is described in U.S. Pat. No. 4,561,800 [Hatakenaka et al. (Hatakenaka)], the contents of which are hereby incorporated by reference. Hatakenaka teaches a method of and an apparatus for heating a road surface, in which hot air controlled to a predetermined temperature is blown against the road surface so as to heat the road surface. The apparatus includes a hot air generator provided with a burner and a thermal control unit, and a number of ducts formed with blowing pores for blowing the hot air against the road surface. Hatakenaka purports that the apparatus facilitates reducing the amount of smoke produced during heating of the asphalt surface. A principal consideration in Hatakenaka is the ability to control the temperature of the hot air. Thus, the essence of Hatakenaka is the provision of hot air at a controlled temperature which hot air is used as the means by which the road surface is heated. Hatakenaka asserts that one of the advantages of the invention is the ability to adjust the "thermal capability" of the heater simply by adjusting the temperature of the hot air itself. This underlies the notation that, for all intents and purpose, Hatakenaka relates to an apparatus which provides substantially all heat by convection.

One of the principal difficulties with hot air and convection heaters generally, and the apparatus taught by Hatakenaka specifically, used in asphalt surface recycling relates to the inability to convey sufficient amounts of the hot air to the asphalt surface to enable heat transfer to take place to the desired temperature and depth in the asphalt surface. The principal reason for this is the size and hot air throughput (e.g. cubic feet per minute or "cfm") necessary to expose the asphalt surface to sufficient heat for a sufficient period of time to heat the surface at a commercially viable rate of speed (e.g. 10–30 feet/minute) makes it impractical and/or prohibitively expensive to build a commercially useful apparatus. The result of this is that, in the asphalt surface recycling art, hot air and convection heaters are not commercially viable when compared to radiation heaters.

It would be desirable to have a method and apparatus for heating an asphalt surface which method and apparatus overcome or reduce at least one of the above-identified disadvantages of the prior art.

DISCLOSURE OF THE INVENTION

It is an object of the present invention to provide a novel method for heating an asphalt surface which obviates or mitigates at least one of the disadvantages of the prior art.

It is another object of the present invention to provide a novel apparatus for heating an asphalt surface which obviates or mitigates at least one of the disadvantages of the prior art.

Accordingly, in one of its aspects, the present invention provides a process for heating an asphalt surface comprising the steps of:

igniting in a burner a combustible mixture comprised of a fuel and oxygen to produce a hot gas;

feeding the hot gas to an enclosure having a radiative face disposed above the asphalt surface, the radiative face having a plurality of apertures; and selecting the dimension of the apertures such that the hot gas: (i) heats the radiative face to provide radiation heat transfer to the asphalt surface; and (ii) passes through the apertures to provide convection heat transfer to the asphalt surface.

In another of its aspects, the present invention provides an asphalt surface heating apparatus comprising a hot gas producing burner and an enclosure comprising an inlet for receiving hot gas from the burner and a radiative face having a plurality of apertures, the apertures having a dimension such that the hot gas: (i) heats the radiative face to provide radiation heat transfer to the asphalt surface; and (ii) passes through the apertures to provide convection heat transfer to the asphalt surface.

The present inventors have discovered that it is possible to achieve substantially uniform, quick and efficient heating of an asphalt surface by utilizing an asphalt surface heating apparatus which is capable of a total heat transfer ($Q_{TOTAL}$) made up of both convection heat transfer ($Q_C$) and radiation heat transfer ($Q_R$) as follows:

$$Q_{TOTAL}=Q_C+Q_R$$

Preferably, $Q_C$ is from about 20% to about 80%, more preferably from about 35% to about 65%, even more preferably from about 40% to about 60%, most preferably from about 45% to about 55% of $Q_{TOTAL}$, with the remainder in each case being $Q_R$.

For present purposes, $Q_C$ may be readily calculated empirically according to the following equation:

$$Q_C=\hbar A(T_1-T_2)$$

wherein:

$\hbar$=the convection heat-transfer coefficient;

A=the total surface area of the heater;

$T_1$=the temperature of the hot gas; and $T_2$=the temperature of the asphalt surface.

Further, $Q_R$ may be readily calculated empirically according to the following equation:

$$Q_R = \epsilon \sigma A (T_1^4 - T_2)$$

wherein:

$\epsilon$=the total emissivity of the radiative surface;

$\sigma$=the proportionality (Stefan-Boltzmann) constant;

A=the total surface area of the heater;

$T_1$=the temperature of the radiative face of the enclosure; and $T_2$=the temperature of the asphalt surface.

These equations and the use thereof are within the purview of a person skilled in the art and are discussed in more detail in HEAT TRANSFER by J. P. Holman (7th Edition, 1992), the contents of which are hereby incorporated by reference.

For example, a useful asphalt surface heating apparatus is constructed has a radiative face constructed of oxidized steel and is operated at approximately 1200° F. The radiative face is used approximately 3 inches off the asphalt surface. Radiative surface is about 12 feet wide by 26 feet wide and is provide with a total of approximately 15,500 circular apertures have a diameter of 0.25 inches. For such an apparatus, a person skilled in the art can readily calculate that $Q_C$ is approximately 480 kW (48% of total heat transfer) whereas $Q_R$ is approximately 520 kW (52% of total heat transfer).

One of the principal advantages of the present asphalt surface heating apparatus is that it is not dependent on the use of a particular type of fuel. Thus, it is believed that the present asphalt surface heating apparatus is the first such apparatus which combines at least partial heat transfer by radiation with the flexibility of using a liquid fuel such as diesel fuel.

Throughout this specification, reference is made to combustion a mixture of fuel and oxygen. As is well known, pure oxygen is extremely flammable and dangerous to handle and use. Thus, for most applications, it is convenient to use ambient air for admixture with the fuel. It should be clearly understood, however, that the scope of the present invention includes the non-air gases comprising or consisting of oxygen.

Preferably, the present asphalt surface heating apparatus further comprises means to dispose the enclosure above the asphalt surface at a distance of from about 1 to about 6, more preferably from about 2 to about 4, most preferably from about 2 to about 3, inches above the asphalt surface being heating. This serves to optimize exposure of the asphalt surface to radiation emanating from the radiative face of the enclosure.

Preferably, the enclosure in present asphalt surface heating apparatus comprises a plurality of substantially adjacent tubes, each of the tubes have a radiative face. It is particularly preferred to dispose the tubes in a manner whereby a gap or spacing is provided between adjacent pairs of tubes. The provision of such a gap or tube facilitates recycling of the hot gas impacting the asphalt surface. Specifically the hot gas may be drawn back to the burner through the gap or spacing between adjacent pairs of tubes. Ideally, the gap or spacing between adjacent pairs of tubes is of a size such that the velocity of the hot gas being recycled is in the range of from about 20% to about 80%, preferably from about 30% to about 70%, more preferably from about 40% to about 60%, most preferably from about 45% to about 55% of the velocity of the hot gas passing through the apertures in the tubes.

The temperature of the hot gas and the radiative face of the enclosure are approximately the same although this is not essential. Preferably, this temperature is in the range of from about 700° to about 1600° F., more preferably from about 900° to about 1400° F., most preferably from about 1000° to about 1200° F. Ideally the temperature is about 1100° F.

BRIEF DESCRIPTION OF THE DRAWINGS

Embodiments of the present invention will now be described with reference to the accompanying drawings wherein like numerals depict like parts and in which.

BEST MODE FOR CARRYING OUT THE INVENTION

Figure 1:
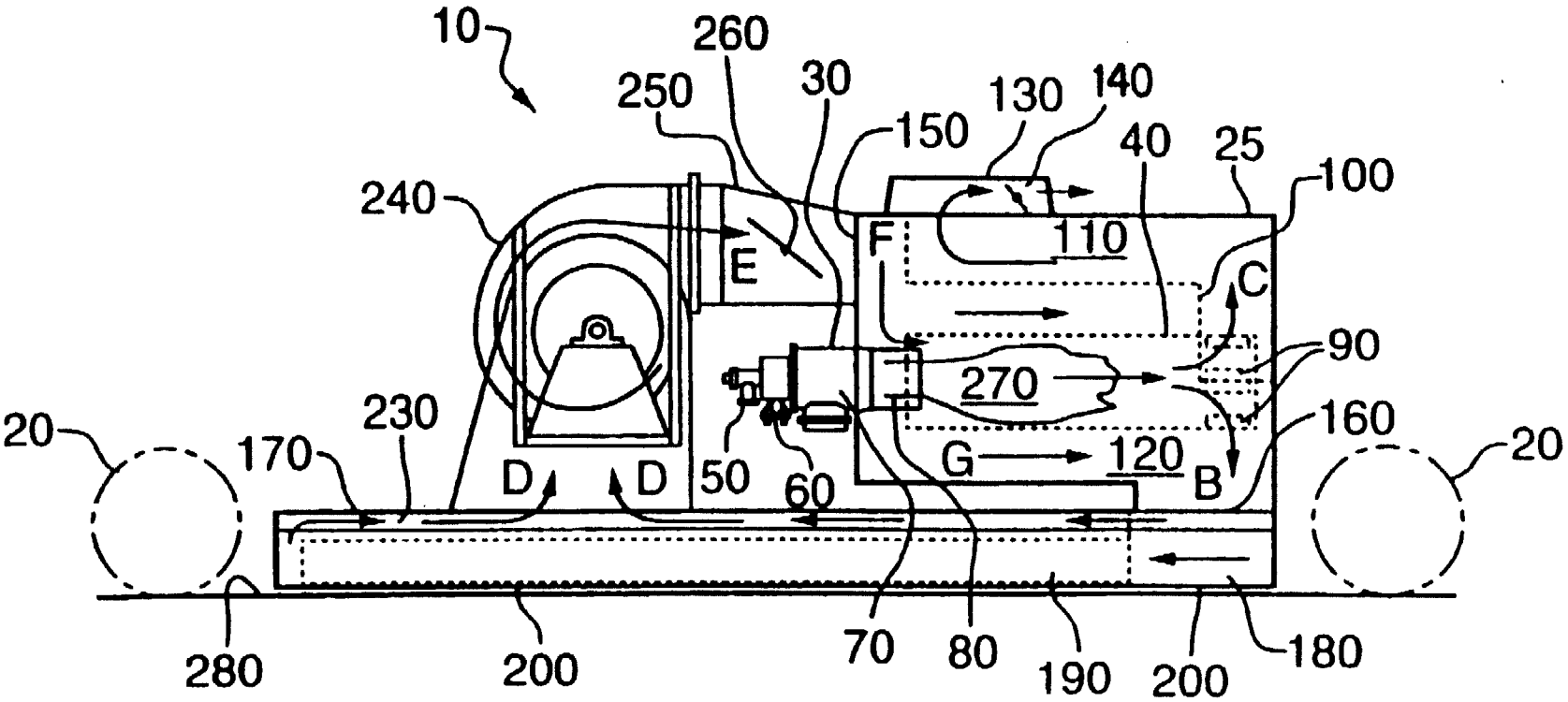
FIG. 1 illustrates a side elevation of a schematic of the present asphalt surface heating apparatus.
Figure 2:
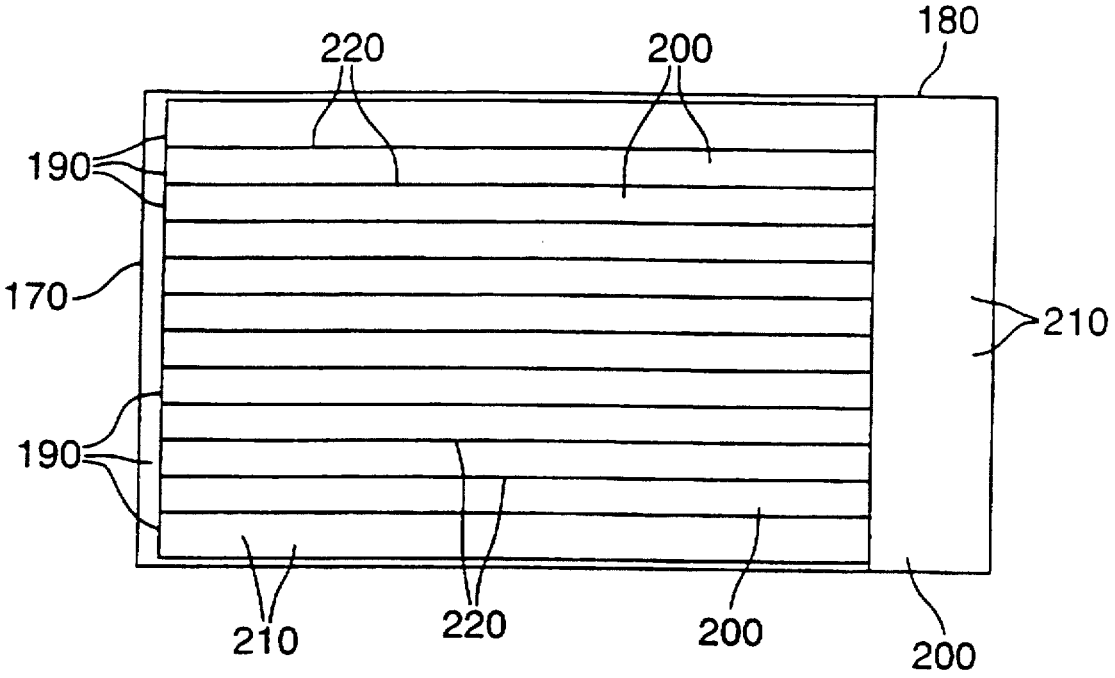
FIG. 2 illustrates a bottom view of a portion of the apparatus illustrated in FIG. 1.
Figure 3:
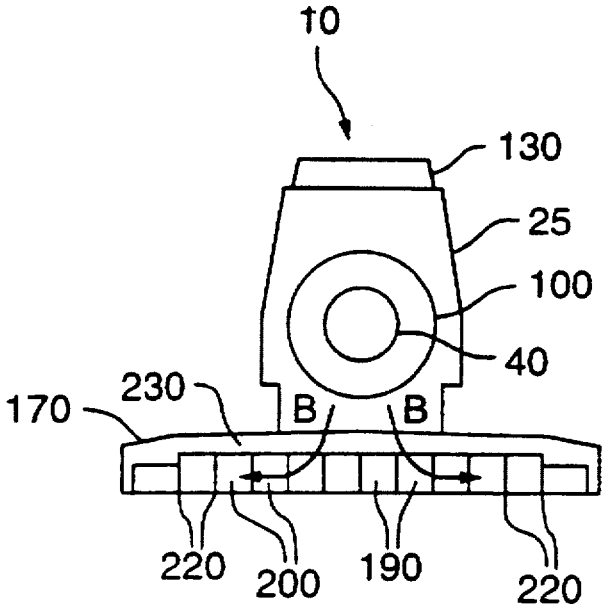
FIG. 3 illustrates a front elevation of the apparatus illustrated in FIG. 1.

With reference to FIGS. 1–3, there is illustrated an asphalt surface heating apparatus 10. Heating apparatus 10 is mobile and is mounted on or attached to a suitable vehicle (not shown) mounted on wheels 20 (illustrated in a ghosted fashion).

Heating apparatus 10 includes a housing 25 having a burner 30, the outlet end of which is disposed in a combustion chamber 40. Burner 30 comprises a fuel inlet 50, an oxygen inlet 60 and a mixing/atomization chamber 70. Burner 30 further comprises a nozzle 80 disposed in housing 25. As illustrated, the downstream end of nozzle 80 is surrounded by the inlet of combustion chamber 40. While it is possible to dispose the end of nozzle 80 in sealing engagement with the inlet of combustion chamber 40, it is particularly preferred to have a space between the end of nozzle 80 and combustion chamber 40.

Housing 25 is divided by a wall 100 into an exhaust gas housing 110 and a hot gas housing 120. As illustrated, combustion chamber 40 comprises a plurality of combustion apertures 90 disposed such that they are in both exhaust gas housing 110 and hot gas housing 120. Exhaust gas housing 110 is connected to an exhaust 130 equipped with a damper 140. It is a preferred feature of combustion chamber 40 that size and number of apertures 90 is selected so as to result in from about 5% to about 20%, more preferably from about 5% to about 15%, most preferably from about 8% to about 10%, by volume of the total volume of hot gas produced in combustion chamber 40 being directed to exhaust gas housing 110 with remainder being directed to hot gas housing 120. In practice, this results in the majority of the aperture surface area (i.e. the total surface of apertures 90) being represented by apertures which are in hot gas housing 120.

Hot gas housing 120 comprises a hot gas recycle inlet 150 and a hot gas outlet 160. Hot gas outlet 160 is connected to a plenum 170. Plenum 170 comprises a hot gas supply chamber 180 which is connected to a plurality of hot gas discharge enclosures 190. Hot gas supply chamber 180 and hot gas discharge chambers each comprise a radiative face 200. Each radiative face 200 comprises a plurality of apertures 210. Hot gas discharge chambers 190 are arrange such that there is provided a spacing 220 between adjacent pairs of chambers.

Plenum 170 further comprises a recycle gas return chamber 230 which is connected to a recirculation fan unit 240 having disposed therein a blower (not shown). Recirculation fan unit 240 is connected to housing 25 by a recycle gas supply chamber 250 having damper 260 disposed therein.

In operation, fuel and oxygen are introduced into inlets 50 and 60, respectively, of burner 30 wherein they are mixed and atomized (if the fuel is a liquid at ambient temperature and pressure) in chamber 70 to form a combustible mixture. The combustible mixture is then passed to nozzle 80 wherein ignition occurs result in the production of a flame 270 and hot gas. The hot gas generally moves in the direction of arrow A whereby it exits combustion chamber 40 via apertures 90 in two streams. The majority of hot gas exits as depicted by arrow B a minor amount of hot gas exits as depicted by arrow C.

Hot gas depicted by arrow B enters plenum 170 through hot gas outlet 160 wherein it is fed to hot gas supply chamber 180 and hot gas discharge chambers 190. The hot gas then exits chambers 180 and 190 via apertures 210 in the radiative faces 200 of each chamber 180 and 190. By careful design of radiative faces 200 in chambers 180 and 190, and selection of the number and size of apertures 210, radiative faces 200 facilitate both radiation and convection heat transfer. Thus, the hot gas serves to heat radiative faces 200 to a temperature at which they emit radiation, preferably infrared radiation. Concurrently, hot gas passes through apertures 210 at high velocity and impinges on an asphalt surface 280 to be heated thereby be providing convection heat transfer.

Recirculation fan unit 240 serves to recycle gas depicted by arrows D through spacings 220 between adjacent pairs of hot gas discharge chambers 190. Recirculation fan unit 240 feeds the recycle gas to recycle gas supply chamber 250 as depicted by arrow E. Recycle gas entering housing 25 either (i) enters combustion chamber 40 as depicted by arrow F wherein any partially- or non-combusted fuel is fully burned; or (ii) flows around and heat exchanges with the outside of combustion chamber 40 as depicted by arrows G after which it is mixed with hot gas emanating from combustion chamber 40 as depicted by arrow B.

The present asphalt surface heating apparatus can be used to advantage in virtually all hot-in-place recycling process include those described in the United States patents referred to hereinabove. However, the present asphalt surface heating apparatus finds particular advantageous application when combined with the process and apparatus described in each of copending Canadian patent applications 2,061,682 and 2,102,090, and International patent application WO93/17185, the contents of each of which are hereby incorporated by reference.

Accordingly, while this invention has been described with reference to illustrative embodiments, this description is not intended to be construed in a limiting sense. Various modifications of the illustrative embodiments as well as other embodiments of the invention, will be apparent to persons skilled in the art upon reference to this description. For example, it is possible to construct the present asphalt surface heating apparatus such that it provides radiation heat transfer and convection heat transfer in sequential or, preferably, a cyclical and sequential manner. This can be achieved in a number of ways such as the provision of tubes arranged substantially transverse to the asphalt surface The tubes, optionally having apertures, as described hereinabove and could have disposed between them a conventional radiation heater. Alternatively, it is possible to construction a train of apparatus which alternates between a convection heater and a radiation heater. The net result of this is an apparatus train which, in total, transfers heat by radiation and convection. It is therefore contemplated that the appended claims will cover any such modifications or embodiments.

What is claimed is:

1. A process for heating an asphalt surface comprising:

igniting in a burner a combustible mixture which comprises a fuel and oxygen to produce a hot gas;

feeding the hot gas to an enclosure having a radiative face disposed above the asphalt surface, the radiative face having a plurality of apertures; and selecting the dimension of the apertures such that the hot gas:

(i) heats the radiative face to provide radiation heat transfer to the asphalt surface; and (ii) passes through the apertures to provide convection heat transfer to the asphalt surface, the radiation heat transfer being from about 20% to about 80% of the total heat transfer, the remainder being convection heat transfer.

2. The process defined in claim 1, wherein the radiation heat transfer is from about 35% to about 65% of the total heat transfer, the remainder being convection heat transfer.

3. The process defined in claim 1, comprising the further step of disposing the enclosure above the asphalt surface at a distance of from about 1 to about 6 inches.

4. The process defined in claim 1, wherein the enclosure comprises a plurality of substantially adjacent tubes in a spaced relationship to define a gap between each pair of adjacent tubes, each of said tubes having the radiative face.

5. The process defined in claim 4, comprising the further step of recycling a portion of the hot gas to the burner through the gap between the adjacent tubes after the hot gas has passed through the apertures in the enclosure.

6. The process defined in claim 5, comprising the further step of selecting the size of the gap such that the velocity of the hot gas being recycled is in the range of from about 20% to about 80% of the velocity of the hot gas passing through the apertures in the enclosure.

7. The process defined in claim 5, comprising the further step of selecting the size of the gap such that the velocity of the hot gas being recycled is in the range of from about 30% to about 70% of the velocity of the hot gas passing through the apertures in the enclosure.

8. The process defined in claim 1, wherein the fuel is diesel fuel.

9. The process defined in claim 1, wherein the radiation heat transfer and the convection heat transfer both emanate from a single enclosure.

10. An asphalt surface heating apparatus comprising a hot gas producing burner and an enclosure comprising an inlet for receiving hot gas from the burner and a radiative face having a plurality of apertures, the apertures having a dimension such that the hot gas:

(i) heats the radiative face to provide radiation heat transfer to the asphalt surface; and (ii) passes through the apertures to provide convection heat transfer to the asphalt surface, the radiation heat transfer being from about 20% to about 80% of the total heat transfer, the remainder being convection heat transfer.

11. The asphalt surface heating apparatus defined in claim 10, wherein the radiation heat transfer is from about 35% to about 65% of the total heat transfer, the remainder being convection heat transfer.

12. The asphalt surface heating apparatus defined in claim 10, further comprising means to dispose the enclosure above the asphalt surface at a distance of from about 1 to about 6 inches.

13. The asphalt surface heating apparatus defined in claim 10, wherein the enclosure comprises a plurality of substantially adjacent tubes in a spaced relationship to define a gap between each pair of adjacent tubes, each of said tubes having the radiative face.

14. The asphalt surface heating apparatus defined in claim 13, wherein the tubes have a substantially non-circular cross-section.

15. The asphalt surface heating apparatus defined in claim 13, wherein the tubes have a substantially rectangular cross-section.

16. The asphalt surface heating apparatus defined in claim 10, further comprising means to recycle a portion of the hot gas to the burner after the hot gas has passed through the apertures in the enclosure.

17. The asphalt surface heating apparatus defined in claim 16, wherein the gap is of a size such that the velocity of the hot gas being recycled is in the range of from about 20% to about 80% of the velocity of the hot gas passing through the apertures in the enclosure.

18. The asphalt surface heating apparatus defined in claim 16, wherein the gap is of a size such that the velocity of the hot gas being recycled is in the range of from about 30% to about 70% of the velocity of the hot gas passing through the apertures in the enclosure.

19. The asphalt surface heating apparatus defined in claim 10, wherein a single enclosure provides the radiation heat transfer and the convection heat transfer.

* * * * *